US005335819A

United States Patent [19]

Martin

[11] Patent Number: 5,335,819

[45] Date of Patent: Aug. 9, 1994

[54] POSTMIX BEVERAGE DISPENSER AND A METHOD FOR MAKING A BEVERAGE DISPENSER

[75] Inventor: Herman H. Martin, Schaumburg, Ill.

[73] Assignee: Wilshire Partners, Cleveland, Ohio

[21] Appl. No.: 976,415

[22] Filed: Nov. 13, 1992

[51] Int. Cl.[5] ..... B67D 5/62

[52] U.S. Cl. ..... 222/146.6; 222/129.1; 285/137.1

[58] Field of Search ..... 222/129.1, 131, 146.6; 62/390, 398, 399; 285/25, 28, 137.1

[56] References Cited

U.S. PATENT DOCUMENTS

| | | | |
|---|---|---|---|
| 2,814,184 | 11/1957 | Johnson | 62/390 |
| 3,009,337 | 11/1961 | Johnson | 62/390 |
| 3,240,395 | 3/1966 | Carver | 222/129.1 |
| 3,331,536 | 7/1967 | De Lorenzo | 222/129.1 |
| 3,853,244 | 12/1974 | Neumann | 222/129.1 |
| 4,291,546 | 9/1981 | Rodth | 62/398 |
| 4,592,490 | 6/1986 | McMichael | 222/146.6 |
| 4,678,104 | 7/1987 | Pritchett | 222/146.6 |
| 4,901,887 | 2/1990 | Burton | 222/131 |
| 5,171,044 | 12/1992 | Umezawa et al. | 285/137.1 |
| 5,249,710 | 10/1993 | Hassell et al. | 222/146.6 |

OTHER PUBLICATIONS

Selmix Brochure, "Concord" (no date).
Selmix Brochure, "York" (no date).
Selmix Brochure, "Revere" (no date).

*Primary Examiner*—Andres Kashnikow
*Assistant Examiner*—Philippe Derakshani
*Attorney, Agent, or Firm*—Vickers, Daniels & Young

[57] ABSTRACT

A beverage dispenser provides uniformly chilled carbonated beverages during peak demand and off-peak demand. The dispenser includes a soda and syrup chiller, beverage dispensing heads and an insulated tower assembly between the chiller and the dispensing heads.

25 Claims, 6 Drawing Sheets

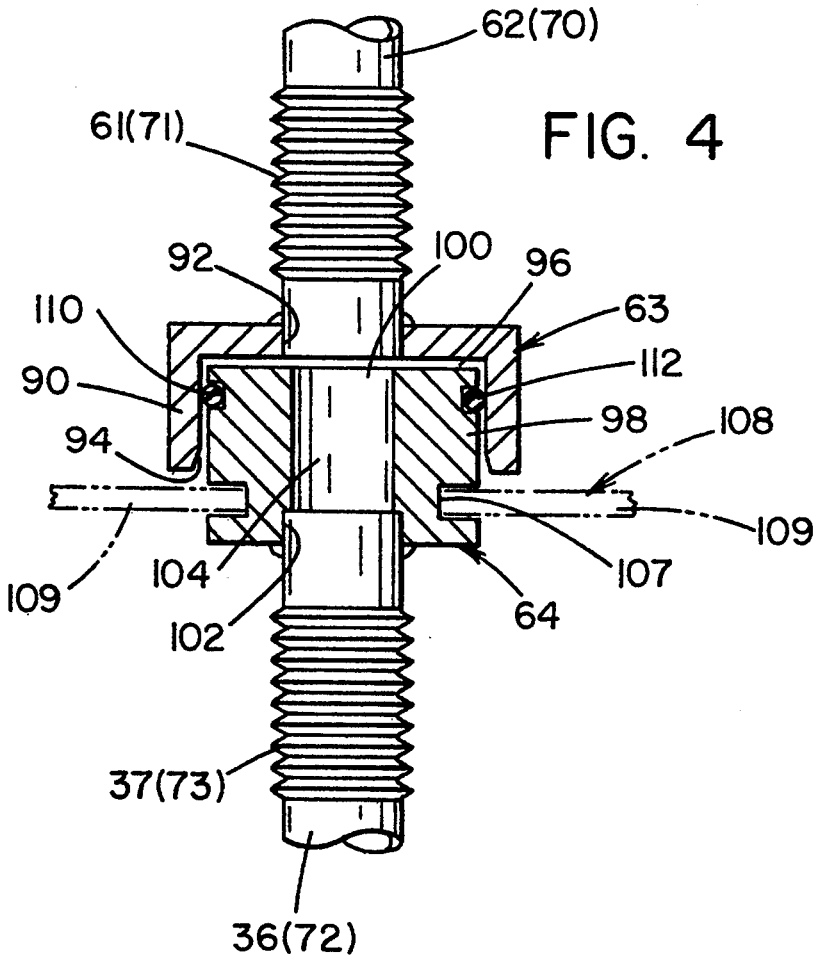
FIG. 4
FIG. 5
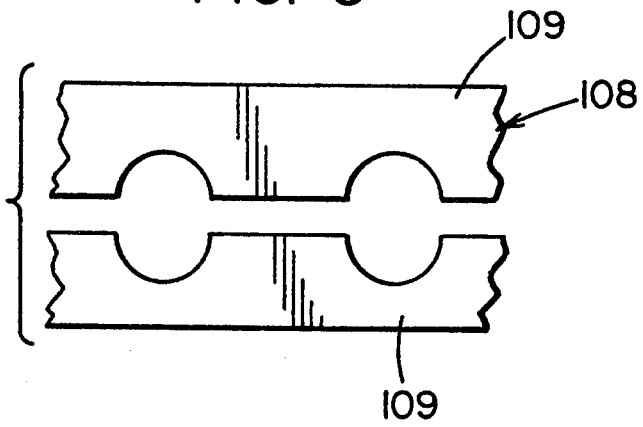

POSTMIX BEVERAGE DISPENSER AND A METHOD FOR MAKING A BEVERAGE DISPENSER

BACKGROUND OF THE INVENTION

This invention relates to a postmix beverage dispenser and in particular to a beverage dispenser with improved low temperature holding characteristics and a method for making such a dispenser.

Carbonated beverages are sold in restaurants, snack shops, amusement parks, fast food outlets and other establishments throughout the world. Many of these beverages are mixed and dispensed on the spot in postmix beverage dispensers. Generally, a postmix beverage dispenser is provided with a plurality of flavoring syrups and carbonated water which are chilled and mixed within the dispenser and poured into a cup or glass. It is desirable to dispense beverages at a uniform low temperature. Dispensing of a consistently cold beverage results in a more uniform mix of syrup and soda water and also allows better retention of carbonation in the beverage.

Postmix beverage dispensers generally comprise at least one soda conduit carrying carbonated water to a soda manifold, a plurality of syrup conduits carrying flavoring syrup, a cooler and a number of dispensing heads. The soda manifold is often positioned near the dispensing heads and feeds soda to the heads through short tubes. The cooler chills the soda and syrup within their respective conduits. The cooler can be a mechanical cooler similar in operation to an air conditioner or it can be an ice chest type cooler. In an ice chest type cooler, the soda and syrup conduits are embedded within an aluminum block in contact with the bottom of a chest of ice. The ice cools the block, which is often called a cold plate, which in turn cools the syrup and soda. The chilled soda and syrup is conveyed from either type of cooler through a tower which supports dispensing heads at a convenient location for filling beverage cups. During peak dispensing time, when a restaurant is serving a meal or the like, the flow of beverage through the beverage dispenser is regular and high. A uniformly chilled product is generally provided. However, in off-peak times, soda and syrup can sit for a long period of time in the conduits through the tower leading to the dispensing heads. The soda and syrup can warm due to exposure to ambient conditions resulting in a less than optimal drink. The problem is generally referred to as the casual drink problem.

In the past, people have sought to address the casual drink problem by various means. One mechanism was simply the insulation of the tower area by the filling of it with a insulation material. However, access openings and loose insulation are often required in the manufacturing process. Over a long period of time, the material within the soda and syrup tubes in the tower would still warm. Other approaches included recirculating soda water through the soda conduits in an effort to chill the conduits. Mechanical answers to the casual drink problem are complicated, subject to failure, noisy and sometimes disturbing to operators. Heretofore, the casual drink problem has not been adequately addressed and less than optimal beverages which are flat, mismixed and otherwise unacceptable to soft drink manufacturers and/or consumers have been served.

These and other problems are overcome by the present invention wherein a postmix beverage dispenser adapted to provide uniformly chilled beverages is described.

SUMMARY OF THE INVENTION

In accordance with the present invention there is provided a postmix beverage dispenser in which the syrup and soda conduits from a cooler to several beverage dispensing heads are insulated over a major portion of their length.

Still further in accordance with the invention, the syrup and soda conduits from the cooler to the beverage dispensing heads are preassembled into a body of foam insulation prior to assembly of the finished beverage dispenser.

In accordance with another aspect of the invention, a modular well insulated beverage dispenser comprises an ice chest assembly or cooler module and a tower assembly or module which are easily mated to one another to provide a well insulated whole. The ice chest assembly has a body of foamed in place insulation protecting the syrup and soda tubes and a top surface from which the tubes protrude. The tower assembly has a body of foamed in place insulation protecting syrup and soda conduits having connector receptacles on their lower ends which receive the tubes from the ice chest assembly providing a well insulated whole.

Yet further in accordance with the invention, a soda manifold having at least one soda inlet and a soda outlet for each dispensing head is embedded in the cold plate.

Still further in accordance with the invention, bellows portions are provided in the syrup and soda conduits within the preassembled tower insulation allowing a certain amount of mismatch in connection to the tubes exiting the cooler.

Yet further in accordance with the invention, connector halves are provided on the bottom of the conduits and on top of the tubes.

It is the primary object of the present invention to overcome the warm causal drink problem without the requirement for recirculation of soda or other active mechanical strategies.

It is another object of the present invention to provide a superior insulation characteristic for that portion of a postmix beverage dispenser downstream from the cold plate.

It is still another object of the present invention to provide a mechanism for keeping soda chilled in a soda manifold within a cold plate in a postmix beverage dispenser.

It is still another object of the present invention to provide a postmix beverage dispenser having greater resistance to failure in the field due to leaks.

It is still another object of the present invention to provide a method of assembling a postmix beverage dispenser allowing for a slight mismatch between various elements.

It is still another object of the present invention to provide a postmix beverage dispenser capable of providing a uniform, superior soft drink product under peak conditions and off-peak conditions alike.

These and other objects and the advantages of the invention will become apparent from the following description of a preferred embodiment thereof taken together with the accompanying drawings.

BRIEF DESCRIPTION OF THE DRAWINGS

The invention may take physical form in certain parts and arrangements of parts, a preferred embodiment of which is described in detail below and illustrated in the accompanying drawings forming a part hereof wherein:

FIG. 4 shows a detail view of a conduit connector used in the present invention;

FIG. 5 is a top view of a jig used in the present invention;

DETAILED DESCRIPTION OF THE PREFERRED EMBODIMENT

Figure 1:
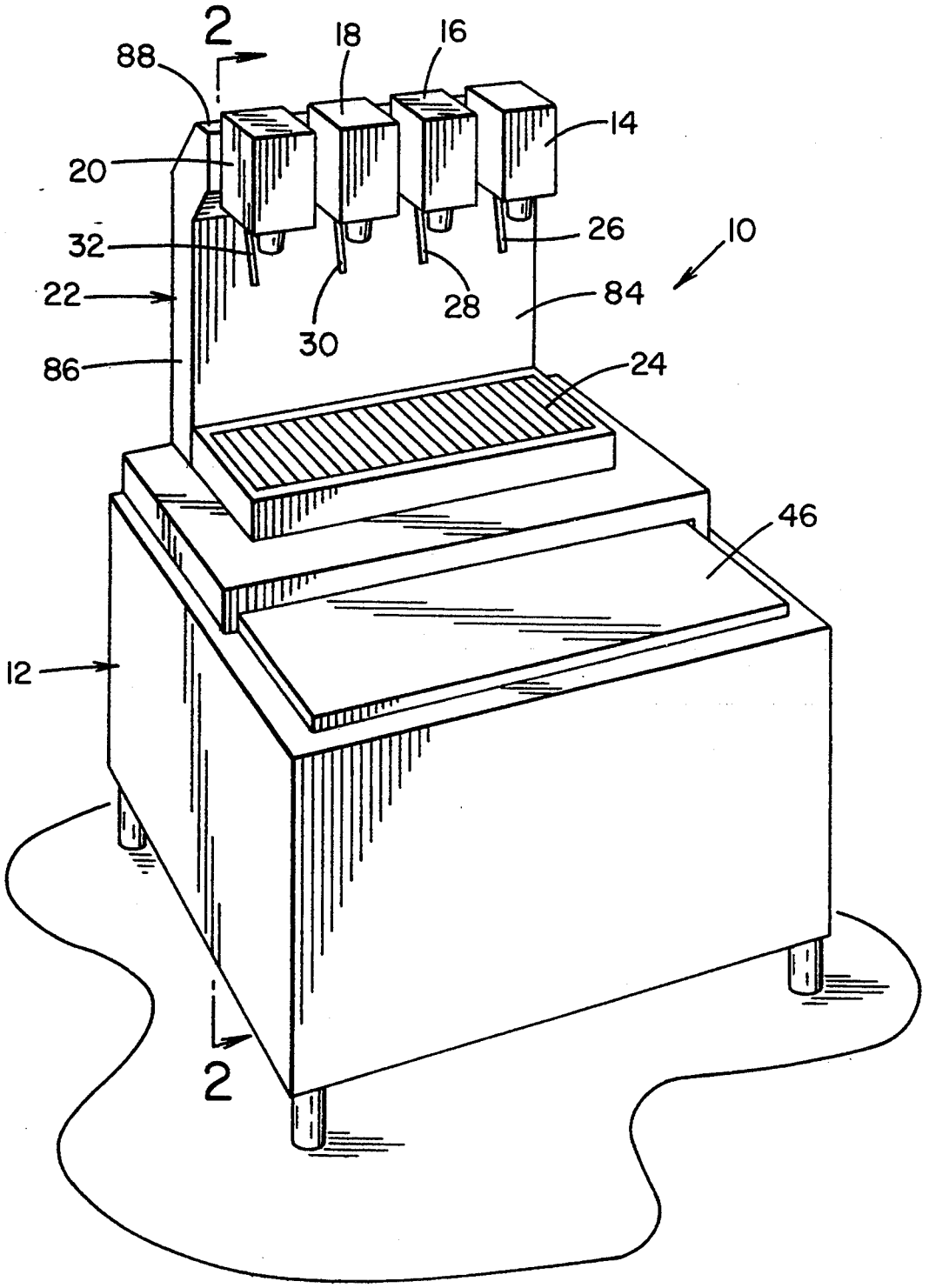
FIG. 1 is a perspective view of a postmix beverage dispenser according to the invention.

Referring now to the drawings wherein the showings are for the purposes of illustrating a preferred embodiment of the invention only and not for the purposes of limiting same, the figures show a postmix beverage dispenser 10 comprised of an ice chest module 12, sometimes referred to herein as cooler module 12, several dispensing heads 14, 16, 18, 20, a tower module 22 and a drip pan 24. The ice chest is kept filled with ice in normal operation. Beverage is dispensed through the beverage heads into cups held against one of the actuator levers 26, 28, 30, 32. The drip pan 24 is positioned below the dispensing heads 14, 16, 18, 20 to collect any spillage or overflow and conduct it to a drain.

Figure 2:
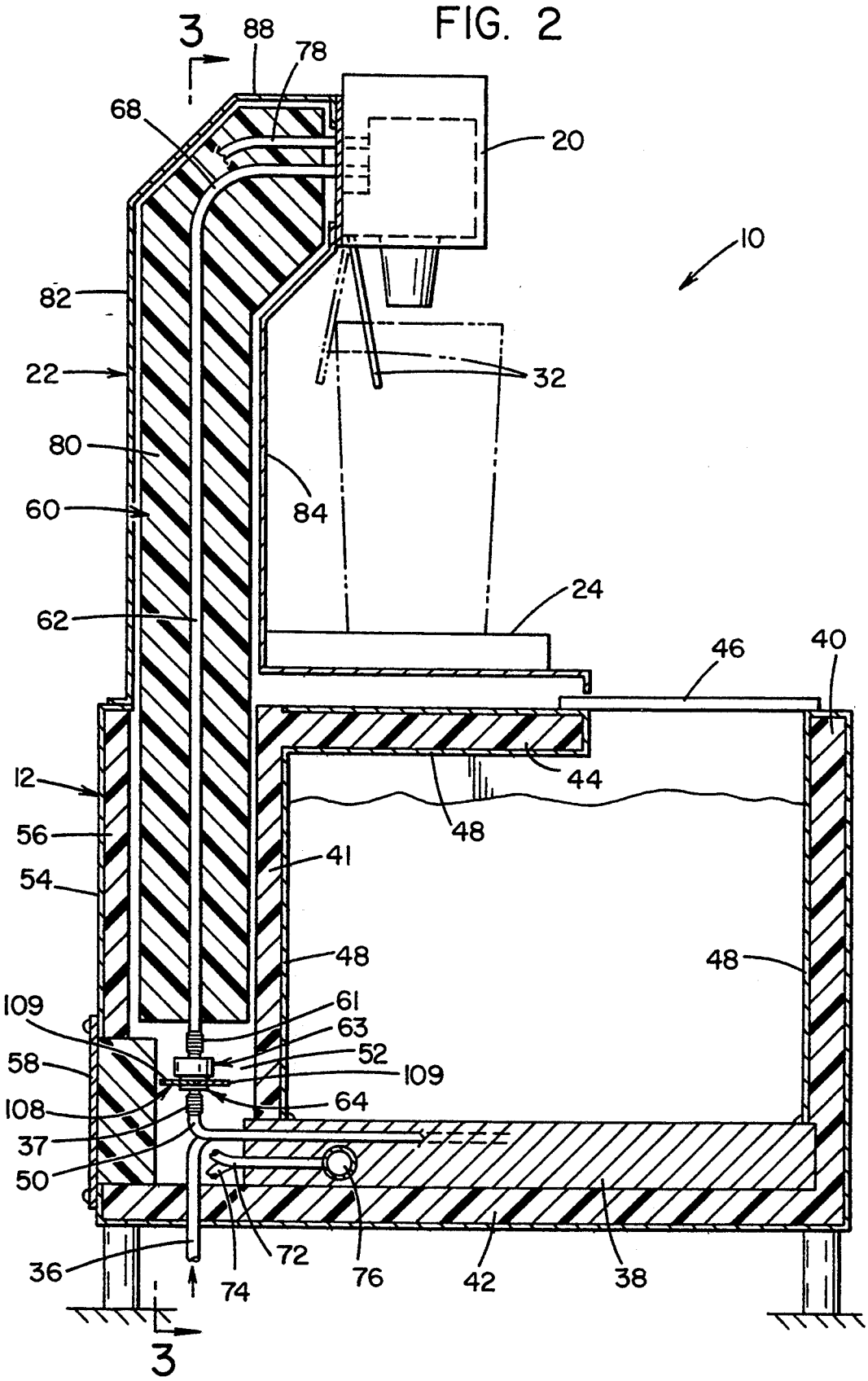
FIG. 2 is a cross section of the dispenser seen in FIG. 1 taken along line 2—2 and showing the tower insulation structure in detail.
Figure 3:
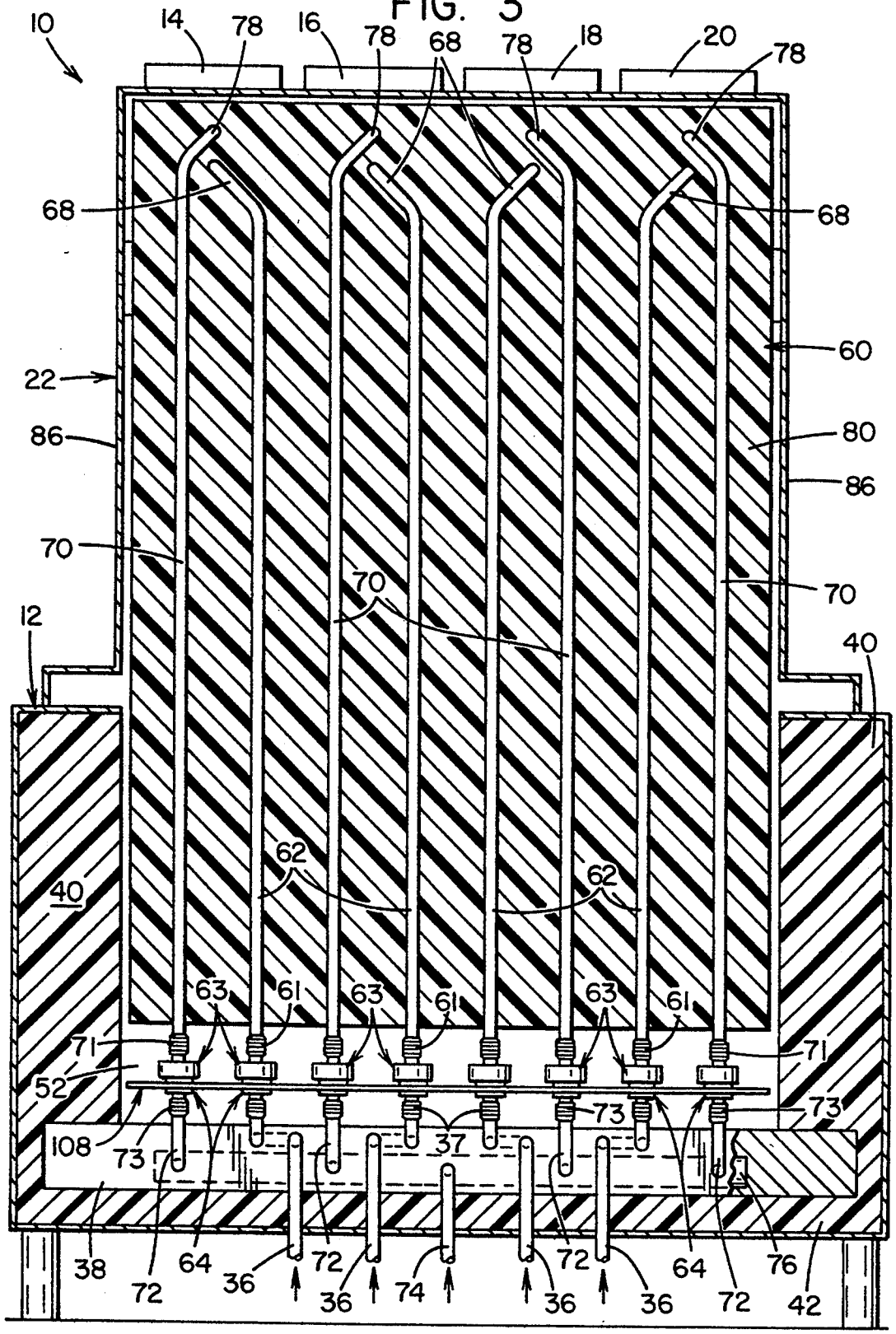
FIG. 3 is a cross section of the tower insulation structure taken line 3—3 of FIG. 2.

FIG. 2 generally shows the flow path for syrup and soda through the dispenser. Syrup flows in an ice chest syrup tube 36 which is imbedded in a cold plate 38 over a substantial portion of its length. The syrup tubes 36 further include a bellows portion 37. The cold plate 38 is normally a block of aluminum which is cast around a number of syrup tubes and soda tubes having sinuous paths within the block of aluminum. The cold plate 38 forms the bottom of the ice chest 12 which is normally kept filled with cube ice or the like and provided with a drain for removal of melted ice. The ice chest 12 is provided with insulated side walls 40 including a rear facing side wall 41 and a bottom insulation 42 under the cold plate 38. The top of the ice chest is sometimes provided with a top insulator 44 and a door 46 which can be opened to fill the ice chest with ice. The ice chest 12 is lined with water impervious surfaces 48 protecting the insulation 40, 41 and 44 and permanently fixed to the cold plate 38. The bottom insulation 42 extends rearwardly from the ice chest sufficiently to protect an area at the rear of the cold plate 38 containing the exposed exit portion 50 of the syrup tubes 36. The dispenser 10 also includes a rear well 52 defined by the rear facing insulated side wall 41 of the ice chest 12 and the rear wall 54 of the dispenser 10. The rear wall 54 includes a body of insulation 56 extending over its entire width. The rear wall 54 is provided with an insulated access plate 58 extending the entire width of the rear wall. An insulated tower assembly 60 is disposed partially in the well 54. The insulted tower assembly 60 is also shown in FIG. 3. The insulated tower assembly 60 is comprised of a number of syrup conduits 62 with bellows portions 61 having conduit connector halves 63 fixed to their lower ends tower module 22 is fastened to ice chest module 12 by connecting conduit connector halves 63 to tube connector halves 64. The conduit connector halves 63 are connected to the tube connector halves 64 of the syrup tubes 36. The tube connector halves 64 include a recess 107 to accommodate jig 108. The syrup conduits 62 are surrounded by insulation 80 over a major portion of their length. The insulation 80 completely surrounds the syrup conduit 62 providing thermal isolation. A top portion 68 of the syrup conduits 62 exits the insulated tower assembly 60 and connects to the respective dispensing heads 14, 16, 18, 20. Several identical syrup conduits are disposed within the insulated tower assembly 60. Additionally, several soda conduits 70 including bellows portions 71 are also disposed in the insulated tower assembly 60. The soda conduits are selected to contain a minimum amount of soda in standby while providing adequate flow to each dispensing head. Stainless tubing of 5/16 diameter has been found to be adequate. The soda conduits are surrounded over most of their length by insulation 80. The soda conduits 70 are fixed to conduit connector halves 63 on their lower end which are in turn connected to several soda tube connector halves 64 which are attached to several soda tubes 72 which receive soda from a supply tube 74 through manifold 76 imbedded in the cold plate 38. The soda tubes 72 include a bellows portion 73. The soda conduit top portions 78 exit the insulation 80 and connect to the dispensing heads 14, 16, 18, 20 providing chilled soda to the heads. The body of foam insulation 80 completely surrounds most of the top portions of the syrup conduits 62 and soda conduits 70. The body of foam insulation 80 is somewhat rigid and holds the syrup conduits 62 and the soda conduits 70 in place. The insulated tower assembly 60 is preassembled. That is, the various syrup conduits 62, soda conduits 70, and conduit connector halves 63 are assembled, placed in a mold, and foamable insulation material is introduced into the mold. The foamable insulation material expands, filling the mold and cures. After curing, a finished insulated tower assembly having conduit connector halves 63 extending therefrom appropriate for interconnection with syrup and soda tube connector halves 64 is provided. Additionally, soda conduit top portions 78 and syrup conduit top portions 68 are held in a position appropriate for interconnecting to the dispensing heads 14, 16, 18, 20.

Syrup tubes 36 and syrup conduits 62 comprise a syrup path from cold plate 38 to dispensing heads 14, 16, 18, 20. This syrup path can be adjusted by bending the bellows portions 37, 61 to facilitate the connection of tues 36 to conduits 62. Soda tubes 72 and soda conduits 70 comprise a soda path from cold plate 38 to dispensing heads 14, 16, 18, 20. This soda path can be adjusted by bending the bellows portions 71, 73 to facilitate the connection of tues 72 to conduit 70.

The insulated tower assembly 60 is surrounded by a tower rear jacket 82, a tower front jacket 84, and tower side jackets 86. As is best seen in FIG. 2, the tower rear jacket includes a tower top jacket 88 protecting the top of the insulated tower assembly 60.

The above described structure is manufactured in a modular manner. The lower portion including the ice chest 12 and the rear well 52 is constructed. When all of the lower portion parts are assembled, one has an ice chest 12 in which a cold plate forms the bottom of the chest and is permanently assembled into the ice chest. The bottom of the rear well 52 contains the syrup tubes 36 and soda tubes 72 and their respective connector halves 64 which are held in position by a jig 108. The bottom of the rear well 52 is open as the insulated access plate 58 is not yet in place. However, the rear well is otherwise defined by four insulated sides comprised of the rearwardly extending insulated side walls 40, the rear facing ice chest insulating side wall 41 and the rear wall insulation 56. The preassembled insulated tower assembly 60 is slid into the rear well 52 and the conduit connector halves 63 are connected to the tube connector halves 64. The connection can be finished through the opening provided by the insulated access plate 58. Once the connections are completed, the access plate 58 is fixed in place completely closing the bottom of the rear well 52. Those portions of the tower jacket 82, 84, 86 and 88 not yet assembled to the ice chest 12 are applied and the dispensing heads 14, 16, 18, 20, if not already on the tower assembly, are connected. The postmix beverage dispenser 10 is complete and ready for shipment and installation. Superior insulation of the syrup and soda paths downstream from the cold plate 38 is provided.

FIG. 4 shows the conduit connector half 63 and the tube connector half 64 in detail. The conduit connector half 63 comprises a metallic cylindrical body 90 having a top opening 92 and a bottom opening 94. A central recess 96 is located within the cylindrical body 90. One of the metallic syrup conduits 62 or the metallic soda conduits 70 is welded into top opening 92. The tube connector half 64 comprises a cylindrical body 98 having a top opening 100 and a bottom opening 102 which are connected by a central bore 104. The tube connector half 64 is welded to one of the metallic syrup tubes 36 or the metallic soda tubes 72. The tube connector half 64 also contains a recess 110 to accommodate an 0-ring 112 in order to provide for a watertight seal between the tube connector half 64 and the conduit connector half 63. A jig 108, consisting of two jig halves 109, holds the syrup tubes 36 or soda tubes 72 in proper alignment. FIG. 5 shows the jig 108 and the jig halves 109 in more detail. The bellows portion 37 of syrup tube 36 allows the tube 36 to be accurately positioned within the jig 108. Furthermore, the bellows portion 61 of syrup conduit 62 allows the syrup conduit 62 and conduit connector half 63 to be positioned over and attached to the tube connector half 64. Thus, slight misalignments or differences in the lengths of the various tubes are corrected.

The ice chest syrup tubes 36, the syrup conduits 62, the soda conduits 70 and the ice chest soda tubes 72 are metallic. No plastic tube portions are required to allow for mismatch between the metallic tubes as mismatch is accommodated by the bellows positions of the tubes and conduits. A more reliable connection is thereby provided.

Figure 6A:
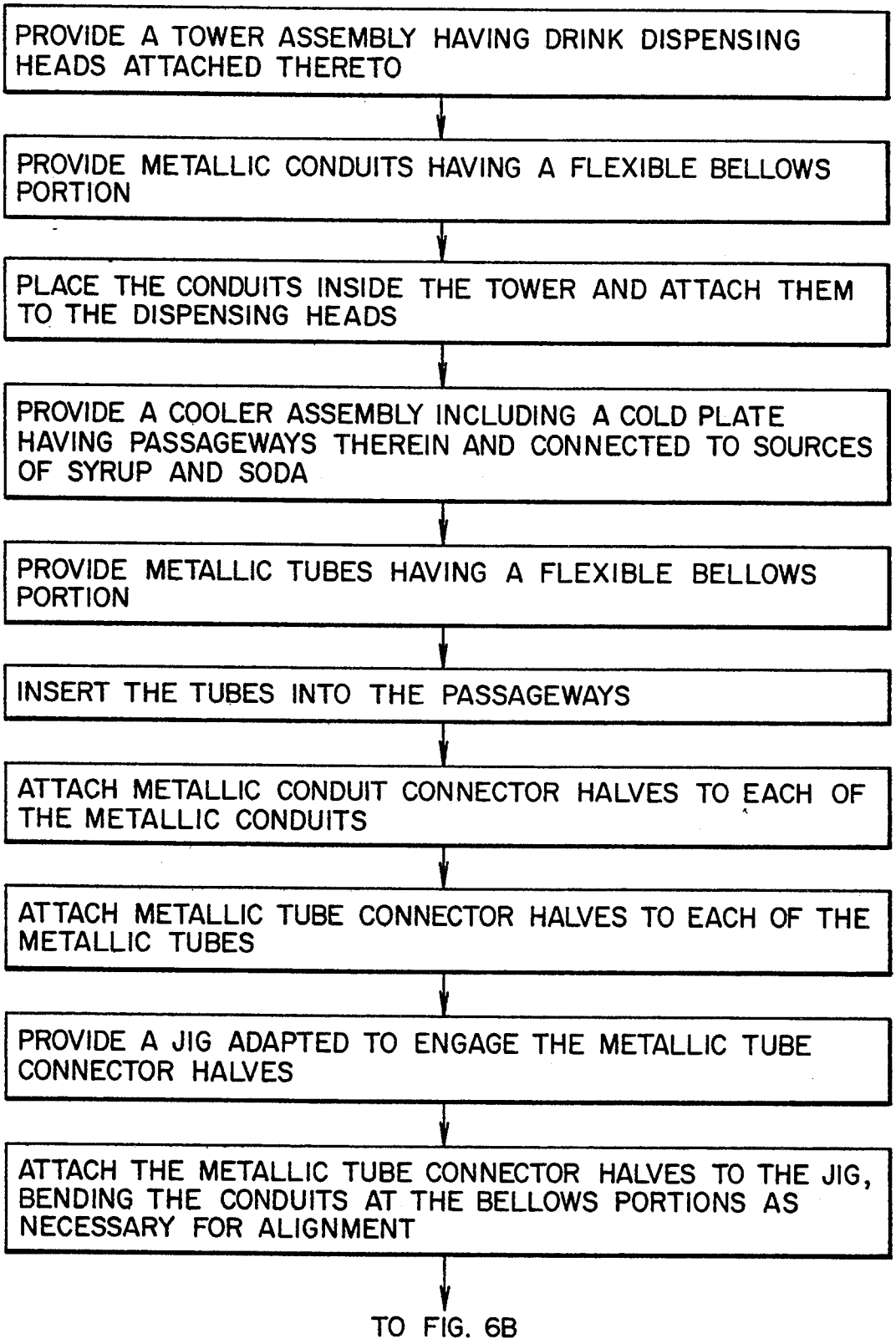
FIGS. 6*a* and 6*b* are a flow chart showing a method of assembling the present invention.
Figure 6B:
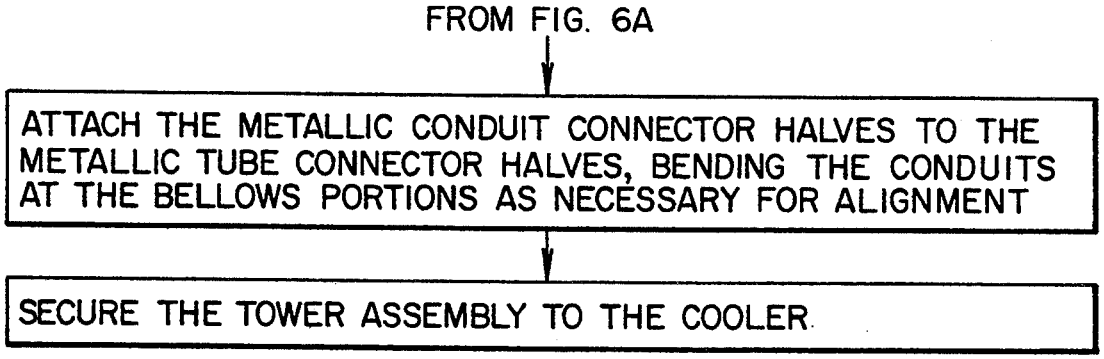

The steps required to assemble the beverage dispenser 10 according to the present invention are shown in FIG. 6. The dispenser 10 is assembled by attaching a plurality of dispensing heads 14, 16, 18 and 20 to a tower 22, inserting metallic conduits 70 into the tower 22 and attaching the metallic conduits 70 to the drink dispensing heads 14, 16, 18 and 20. Each of the conduits 70 includes a bellows portion 71. Foam insulation 50 is then blown into the tower 22 and allowed to cure. An ice chest 12 including a cold plate 38 is provided with metallic tubes 36 exiting from the cold plate 38. Each of these metallic tubes 36 includes a bellows portion 37. Tube connector halves 64 are attached to each of the metallic tubes 36 and conduit connector halves 63 are attached to each of the conduits 70.

A jig 108 is attached to the tube connector halves 64 to hold them in proper position. The tubes 36 may be bent at bellows portions 37 in order to achieve a proper fit in the jig 108. The tower assembly 60 is then lowered onto the ice chest assembly 12 and the conduits 70 are bent at conduit bellows portions 71 so that the conduit connector halves 63 are aligned with the tube connector halves 64. The tube connector halves 64 are then attached to the conduit connector halves 63 and the tower assembly 60 is secured to the ice chest assembly 12.

The invention has been described with reference to the preferred embodiments. It will be appreciated that modifications or alterations could be made without deviating from the present invention. Such modifications and alterations will occur to others upon a reading and understanding of the specification. It is intended that all such modifications and alterations be included insofar as they come within the scope of the appended claims or the equivalents thereof.

Having thus described the invention, it is claimed:

1. A modular apparatus for dispensing beverages comprising: at least one metallic soda tube having a bellows element, said tube receiving carbonated water from a source of carbonated water;

a plurality of metallic syrup tubes having a bellows element, said tubes receiving syrup from a plurality of sources of syrup;

a cooler in heat exchange relationship with said soda tube and said syrup tubes;

a plurality of dispensing heads each of said heads adapted to receive carbonated water and syrup and dispense beverage when actuated;

a tower assembly supporting said heads;

at least one metallic soda conduit having a bellows element and a plurality of metallic syrup conduits having a bellows element within said tower connected to said dispensing heads and to said syrup and soda tubes; and, foam insulation within said tower assembly around said syrup and soda conduits.

2. The apparatus of claim 1 wherein said metallic tubes includes connector halves and said metallic conduits include connector halves.

3. The apparatus of claim 2 wherein said metallic tube connector halves are connected to said metallic conduit.

4. The apparatus of claim 3 including a jig which retains said tube connector halves in alignment.

5. The apparatus of claim 4 wherein said tube connector halves include a recess adapted to accommodate said jig.

6. The apparatus of claim 5 wherein said jig comprises two jig halves.

7. The apparatus of claim 6 wherein said metallic tube connector half comprises a generally cylindrical body having a top surface having a top opening, a bottom surface having a bottom opening, a central bore connecting said top opening with said bottom opening, a recess adapted to accommodate said tube jig, a diameter, and a recess adapted to accommodate an O-ring said O-ring recess being located between said jig recess and said top surface; and said metallic conduit connector half comprises a generally cylindrical body having a top surface having an opening, a bottom surface having an opening, a central recess having an inner diameter slightly larger than the diameter of said metallic tube connector half, and a central bore connecting said top surface opening to said central recess.

8. A method of making a carbonated drink dispenser comprising the steps of:

providing at least one metallic soda tube having a bellows element, said tube being adapted to accept carbonated water from a source of carbonated water;

attaching a metallic tube connector half to each of said at least one metallic soda tubes;

providing a plurality of metallic syrup tubes each having a bellows element, each of said metallic syrup tubes being adapted to accept a plurality of syrups from a plurality of sources of syrup;

attaching a metallic tube connector half to each of said metallic syrup tubes;

providing a cooler in heat exchange relationship with said at least one syrup and soda tubes;

providing a tower adapted to support a plurality of beverage dispensing heads;

providing at least one metallic soda conduit in said tower having a bellows element and connected to a dispensing head;

attaching a metallic conduit connector half to each of said at least one metallic soda conduits;

providing a plurality of metallic syrup conduits, each having a bellows element and connected to a dispensing head;

attaching a metallic conduit connector half to each of said syrup conduits;

attaching each of said metallic conduits to one of the dispenser heads;

attaching each of said metallic tube connector halves to a jig, bending each of said metallic tubes at each of said bellows elements as necessary for alignment;

attaching each of said conduit connector halves to each of said tube connector halves, bending each of said metallic conduits at each of said bellows elements as necessary for alignment; and attaching said tower to said cooler.

9. A modular beverage dispensing apparatus comprising a cooler module including a cold plate in heat exchange relationship with a plurality of syrup tubes, and at least one soda tube;

a tower module including a plurality of dispensing heads, at lest one soda conduit connected to said heads, and a plurality of syrup conduits connected to said heads, said tower module being adapted to be mounted directly on said cooler module;

means for connecting said at least one soda tube to said at least one soda conduit;

means for connecting said syrup tubes to said syrup conduits;

said means for connecting the tubes and conduits also detachably connecting said tower cooler module to said cooler module.

10. An apparatus according to claim 9 wherein said tower module is substantially filled with foam insulation for insulating said conduits and for holding said conduits in a predetermined orientation.

11. An apparatus according to claim 9 wherein said at least one soda conduit has a length which falls within a preselected range of conduit lengths;

said at least one soda tube has a length which falls within a preselected range of tube lengths;

said syrup tubes each have a length which falls within said preselected range of tube lengths;

said syrup conduits each have a length which falls within said preselected range of conduit length;

and including:

means for facilitating the connection of said at least one soda conduit to said at least one soda tube when said length of said at least one soda tube falls within said tube length range and the length of said at least one soda conduit falls within said conduit length range; and means for facilitating the connection of said syrup tubes to said syrup conduits when the length of each of said syrup tubes is within said tube length range and the length of each of said syrup conduits is within said conduit length range.

12. An apparatus according to claim 11 wherein said facilitating means comprises a bellows section in one of said conduits.

13. An apparatus according to claim 12 wherein said facilitating means comprises a bellows element in one of said tubes.

14. A device according to claim 11 wherein said facilitating means can be manipulated to change the orientation of the end of one of said conduits.

15. A device according to claim 11 wherein said facilitating means can be manipulated to change the orientation of the end of one of said tubes.

16. An apparatus according to claim 9 wherein said conduits include a bellows section for varying the length and orientation of the portion of said conduit which is not encased in said foam insulation.

17. An apparatus according to claim 9 wherein said tubes include a bellows element for varying the length and orientation of said tube.

18. An apparatus according to claim 9 wherein said cooler module is compatible with a plurality of tower modules.

19. An apparatus according to claim 9 wherein said tower module is compatible with a plurality of cooler modules.

20. A method of connecting a dispensing head of a tower portion of a beverage dispenser having a plurality of dispensing heads to a source of syrup and to a source of carbonated water comprising the steps of:

providing a section of syrup conduit and a section of syrup tubing wherein at least one of said sections includes a syrup path adjustment means;

providing a section of soda conduit and a section of soda tubing wherein at least one of said sections includes a soda path adjustment means;

connecting one end of said syrup conduit to said dispensing head;

connecting one end of said soda conduit to said dispensing head;

connecting one end of said syrup tube to said syrup source;

connecting one end of said soda tube to said carbonated water source;

attaching a connector half to each of said conduits;

attaching a connector half to each of said tubes;

adjusting said syrup path adjustment means to align said syrup tube and said syrup conduit;

adjusting said soda path adjustment means to align said soda tube and said soda conduit;

connecting said soda conduit connector half to said soda tube connector half;

connecting said syrup conduit connector half to said syrup tube connector half.

21. A modular apparatus for dispensing beverages comprising: at least one soda tube receiving carbonated water from a source of carbonated water;

a plurality of syrup tubes receiving syrup from a plurality of sources of syrup;

an ice chest including a cold plate in heat exchange relationship with said at least one soda tube and said syrup tubes;

a plurality of dispensing heads each of said heads adapted to receive carbonated water and syrup and dispense a beverage when actuated;

a tower supporting said heads; and, at least one soda conduit and a plurality of syrup conduits within said tower connected to said dispensing heads and to said syrup and soda tubes said conduits and tubes further detachably connecting said tower to said ice chest.

22. The apparatus of claim 21 wherein said tower assembly includes foam insulation around said syrup and soda conduits.

23. The apparatus of claim 22, wherein said syrup tubes, said soda tubes, said syrup conduits and said soda conduits are metallic.

24. The apparatus of claim 23 wherein said conduits include a bellows element.

25. The apparatus of claim 23 wherein said tubes include a bellows element.

* * * * *

UNITED STATES PATENT AND TRADEMARK OFFICE

CERTIFICATE OF CORRECTION

PATENT NO. : 5,335,819

DATED : Aug. 9, 1994

INVENTOR(S) : Herman H. Martin et al.

It is certified that error appears in the above-identified patent and that said Letters Patent is hereby corrected as shown below:

In the Title Page, at [75] Inventor:, after "Ill.", insert --and Ronald E. Grimm, Duluth, Georgia--.

Column 6,

In claim 2, line 2, delete "includes" and insert therefor --include--.

Column 7,

In claim 9, line 6, delete "lest" and insert therefor --least--.

Signed and Sealed this

Sixteenth Day of May, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,335,819

DATED : August 9, 1994

INVENTOR(S) : Herman H. Martin et al

It is certified that error appears in the above-indentified patent and that said Letters Patent is hereby corrected as shown below:

On the title page, item [73] Assignee; after "Ohio", insert —and The Coca-Cola Company, Atlanta, Georgia—.

Signed and Sealed this

Seventeenth Day of October, 1995

*Attest:*

Bruce Lehman

BRUCE LEHMAN

*Attesting Officer*

*Commissioner of Patents and Trademarks*